US011696667B2

(12) United States Patent
Eisenbart et al.

(10) Patent No.: US 11,696,667 B2
(45) Date of Patent: Jul. 11, 2023

(54) DOMESTIC DISHWASHER

(71) Applicant: BSH Hausgeräte GmbH, Munich (DE)

(72) Inventors: Bernd Eisenbart, Holzheim (DE); Michael Lugert, Jettingen-Scheppach (DE); Werner Oblinger, Mödingen (DE); Igor Hoffmann, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 177 days.

(21) Appl. No.: 17/427,932

(22) PCT Filed: Jul. 16, 2020

(86) PCT No.: PCT/EP2020/070116

§ 371 (c)(1),
(2) Date: Aug. 3, 2021

(87) PCT Pub. No.: WO2021/018614

PCT Pub. Date: Feb. 4, 2021

(65) Prior Publication Data

US 2022/0087501 A1 Mar. 24, 2022

(30) Foreign Application Priority Data

Jul. 31, 2019 (DE) ..... 10 2019 211 403.2

(51) Int. Cl.
*A47L 15/23* (2006.01)
*A47L 15/42* (2006.01)

(52) U.S. Cl.
CPC ..... *A47L 15/23* (2013.01); *A47L 15/4225* (2013.01); *A47L 2501/20* (2013.01)

(58) Field of Classification Search
CPC ..... A47L 15/22; A47L 15/23; A47L 15/4225; A47L 2501/20
See application file for complete search history.

(56) References Cited

U.S. PATENT DOCUMENTS 10,251,529 B2 * 4/2019 Kim ..... A47L 15/4289
2014/0069462 A1 * 3/2014 Becker ..... A47L 15/4219 134/10

(Continued)

FOREIGN PATENT DOCUMENTS

CA 2861388 C * 10/2018 ..... A47L 15/23
CN 104523208 A 4/2015

(Continued)

OTHER PUBLICATIONS

National search Report DE 10 2019 211 403.2 dated Apr. 21, 2020.
International Search report PCT/EP2020/070116 dated Sep. 29, 2020.

*Primary Examiner* — Benjamin L Osterhout
(74) *Attorney, Agent, or Firm* — Michael E. Tschupp; Andre Pallapies; Brandon G. Braun

(57) ABSTRACT

A household dishwasher includes a washing container receiving a dishwasher load, a pump pot, and a spray arm for applying washing liquor and/or fresh water to the dishwasher load in the washing container. The spray arm is actively driven by a drive system and mounted on the pump pot for rotation about an axis of rotation. The spray arm has a rib geometry that revolves around the axis of rotation and includes an encoding groove running along the axis of rotation. The pump pot includes an encoding rib running along the axis of rotation and corresponding to the encoding groove. The encoding rib is configured for passage through the encoding groove along the axis of rotation during assembly and disassembly of the spray arm so as to enable the spray arm to be assembled on and disassembled from the pump pot in precisely one angular position.

20 Claims, 3 Drawing Sheets

(56) References Cited

U.S. PATENT DOCUMENTS

| | | | | |
|---|---|---|---|---|
| 2015/0352472 | A1 | 12/2015 | Clerkin | |
| 2016/0360945 | A1 * | 12/2016 | Boyer | A47L 15/4219 |
| 2019/0246868 | A1 * | 8/2019 | Kim | A47L 15/0015 |
| 2020/0253452 | A1 | 8/2020 | Daegyu | |

FOREIGN PATENT DOCUMENTS

| | | | | |
|---|---|---|---|---|
| EP | 2606805 | A1 | 6/2013 | |
| WO | 2013132459 | A1 | 9/2013 | |
| WO | WO-2015090461 | A1 * | 6/2015 | A47L 15/00 |
| WO | WO-2016126086 | A1 * | 8/2016 | A47L 15/22 |

* cited by examiner

DOMESTIC DISHWASHER

CROSS-REFERENCES TO RELATED APPLICATIONS

This application is the U.S. National Stage of International Application No. PCT/EP2020/070116, filed Jul. 16, 2020, which designated the United States and has been published as International Publication No. WO 2021/018614 A1 and which claims the priority of German Patent Application, Serial No. 10 2019 211 403.2, filed Jul. 31, 2019, pursuant to 35 U.S.C. 119(a)-(d).

BACKGROUND OF THE INVENTION

The present invention relates to a household dishwasher.

A dishwasher comprises a washing container in which a dishwasher load to be cleaned can be received. To apply washing liquor and/or fresh water to the dishwasher load, a rotating spray arm can be provided within the washing container. This spray arm can be driven either with the aid of the pressure of washing liquor and/or fresh water emerging from spray nozzles of the spray arm or with the aid of an active drive, in particular with the aid of an electric motor. When the spray arm is actively driven, on the disassembly and in particular on the assembly of the spray arm, it is necessary to detect an angular position of the spray arm. For this purpose, sensors that allow the angular position of the spray arm to be determined can be provided on the spray arm.

BRIEF SUMMARY OF THE INVENTION

Against this background, it is an object of the present invention to provide an improved household dishwasher.

Accordingly, a household dishwasher with a washing container, a spray arm for applying washing liquor and/or fresh water to the dishwasher load received in the washing container, a drive system for actively driving the spray arm and a pump pot on which the spray arm is rotatably mounted about an axis of rotation is proposed. Herein, the spray arm comprises a rib geometry that revolves around the axis of rotation and has an encoding groove running along the axis of rotation, wherein the pump pot comprises an encoding rib running along the axis of rotation and corresponding to the encoding groove, which rib can be guided through the encoding groove along the axis of rotation during the assembly and disassembly of the spray arm so that the spray arm can be assembled on and disassembled from the pump pot in precisely one angular position.

The fact that it is only possible for the spray arm to be assembled on and disassembled from the pump pot in precisely one angular position means that incorrect assembly by a user can be reliably excluded. The provision of the encoding groove and the encoding rib eliminates the need for an additional sensor on the spray arm.

The washing container is preferably cuboidal. In particular, the washing container comprises a floor, a top arranged opposite the floor, a door, a rear wall arranged opposite the closed door and two side walls. Dishwasher load receptacles for receiving the dishwasher load can be provided in the washing container. For example, an upper basket, a lower basket and a cutlery drawer are provided. The spray arm can be arranged below the lower basket. The spray arm can in particular be rotatably mounted on the floor.

In the present case, "applying" washing liquor and/or fresh water to the dishwasher load should be understood to mean that the dishwasher load is wetted with washing liquor and/or fresh water with the aid of the spray arm. In the present case "washing liquor" can be understood to mean water mixed with a detergent. The washing liquor can comprise dirt that becomes detached from the dishwasher load. In the present case, the fact that the spray arm is "actively" driven should be understood to mean that the drive system applies a torque to the spray arm. Therefore, in the present case, "active" driving should in particular not be understood as meaning that the spray arm is set into rotation with the aid of spray nozzles. To actively drive the spray arm, the drive system comprises a drive element, in particular an electric motor.

The fact that the rib geometry "revolves" around the axis of rotation should in particular be understood to mean that the rib geometry has a disk-like shape which is rotationally symmetrical to the axis of rotation. However, this does not preclude the possibility of the rib geometry being interrupted. In particular, the rib geometry is interrupted along the axis of rotation by the encoding groove. In the present case, the fact that the encoding rib "corresponds" to the encoding groove should in particular be understood to mean that the encoding rib can be guided through the encoding groove along the axis of rotation. Herein, either the encoding groove and the encoding rib can be in contact or they can also be guided through without contact. In particular, the spray arm can be pulled out of the pump pot and pushed back in along the axis of rotation. However, this is only possible if the spray arm is oriented such that the encoding rib can be guided through the encoding groove. Particularly preferably, the spray arm comprises a cross-arm, which is actively driven with the aid of the drive system, and a spray arm satellite rotatably mounted on the cross-arm. Particularly preferably, the rib geometry with the encoding groove is provided on the cross-arm, in particular on a bearing tube of the cross-arm.

According to one embodiment, the drive system comprises a drive element with a drive shaft that can be rotated about an axis of rotation.

As mentioned above, the drive element can be an electric motor. The drive shaft is in particular guided through a drill hole provided in a base section of the pump pot and sealed therefrom. Hence, the drive element can be positioned outside a wet area of the household dishwasher. Therefore, this eliminates the need for a water-tight embodiment of the drive element.

According to one embodiment, the axis of rotation of the spray arm and the axis of rotation of the drive shaft are arranged parallel to one another and spaced apart from one another.

In the present case, the fact that the axis of rotation of the spray arm and the axis of rotation of the drive shaft are arranged "spaced apart from one another" should in particular be understood to mean that the two axes of rotation are arranged at a distance from one another. This means that the axis of rotation of the drive shaft and the axis of rotation of the spray arm in particular do not coincide. The axis of rotation of the spray arm is in particular the axis of rotation of the aforementioned cross-arm.

According to a further embodiment, the household dishwasher furthermore comprises a gear that bridges a distance between the axis of rotation of the spray arm and the axis of rotation of the drive shaft.

In the present case, the fact that the gear "bridges" the distance between the axis of rotation of the spray arm and the axis of rotation of the drive shaft should in particular be understood to mean that the gear is suitable for transmitting a torque from the axis of rotation to the spray arm. For this purpose, the gear can comprise a multiplicity of gear wheels, a belt drive, a chain drive or other elements suitable for transmitting a torque.

According to a further embodiment, the drive shaft comprises an engagement section configured to engage in a corresponding counter-engagement section of a gear wheel in a form-fitting manner so that the gear wheel can be assembled on the drive shaft in precisely one angular position.

The engagement section can in particular be a lateral milled or flattened area of the drive shaft. The counter-engagement section is accordingly a protrusion provided on the gear wheel, in particular on a central drill hole of the gear wheel, which engages in the engagement section in a form-fitting manner. A form-fitting connection is created by at least two connection partners engaging in or behind one another, in the present case, in the engagement section and the counter-engagement section.

According to a further embodiment, the gear comprises a plurality of gear wheels of which one gear wheel is assembled on the drive shaft and another gear wheel engages in spray-arm toothing of the spray arm in a form-fitting manner.

For example, the gear can comprise three gear wheels. However, the number of gear wheels is basically arbitrary. The spray-arm toothing is in particular provided on the outer side of the bearing tube of the cross-arm. The spray-arm toothing preferably has an involute shape.

According to a further embodiment, viewed along the axis of rotation of the spray arm, the rib geometry is arranged spaced apart from the spray-arm toothing.

In particular, the rib geometry is arranged between the spray-arm toothing and arms of the cross-arm. Particularly preferably, the rib geometry is positioned above the spray-arm toothing. The rib geometry and the spray-arm toothing constitute different components or sections of the spray arm. However, this does not preclude the possibility of the rib geometry and/or the spray-arm toothing being embodied in one piece, in particular in one piece of material, with the spray arm, in particular with the bearing tube of the cross-arm. The arms of the cross-arm are, for example, made of polypropylene (PP), in particular glass-fiber reinforced polypropylene. On the other hand, the bearing tube can be made of polyoxymethylene (POM). Accordingly, the bearing tube can also be referred to as a POM bearing tube or POM bearing part. This means that the bearing tube and the arms can be made of different plastic materials. For example, the arms and the bearing tube can be firmly connected to one another in a plastic injection molding process with the aid of the encapsulation of the different plastic materials.

According to a further embodiment, the drive element comprises a sensor system for detecting an angular position of the drive shaft.

The sensor system can, for example, comprise a fork light barrier with a perforated disk, a cam disk with a switching contact or a Hall sensor. The fact that it is possible for the spray arm to be assembled and disassembled in only one angular position enables the angular position of the spray arm to be detected with the aid of the sensor system of the drive element. As mentioned above, this eliminates the need for separate sensors for the spray arm. The sensor system can in particular be positioned outside the wet region of the household dishwasher.

According to a further embodiment, the pump pot comprises a tubular pump pot dome, on which the spray arm is rotatably mounted about its axis of rotation, wherein the encoding rib is provided on the inner side of the pump pot dome.

In particular the bearing tube of the cross-arm of the spray arm is received in the pump pot dome. The encoding rib extends on the inner side out of the pump pot dome in the direction of the bearing tube. However, herein the encoding rib does not make contact with the bearing tube. The encoding rib can, for example, be rectangular or triangular in cross section. Accordingly, the encoding groove can also have a rectangular or a triangular geometry. However, the geometry of the encoding rib can also be based on or be very similar to the involute shape of the spray-arm toothing. The encoding groove is embodied in a corresponding manner.

According to a further embodiment, the spray arm comprises a cross-arm rotatably mounted on the pump pot, which is actively driven by the drive system, and a spray arm satellite rotatably mounted on the cross-arm.

The spray arm satellite is in particular not actively driven, but is reactively driven by washing liquor and/or fresh water emerging from the spray arm satellite. In the present case, "reactively driven" means that the washing liquor and/or the fresh water emerges from the spray nozzles of the spray arm satellite thus setting it into rotation. It is also possible for special drive spray nozzles to be provided. The spray arm satellite can have a plurality of arms. The spray arm satellite preferably comprises three arms arranged offset to one another by 120°. However, the spray arm satellite can also comprise only two arms or more than two arms.

Further possible implementations of the household dishwasher also comprise combinations, not explicitly named, of features or embodiments described above or below with reference to the exemplary embodiments. Herein, the person skilled in the art will also add individual aspects as improvements or additions to the respective basic form of the household dishwasher.

BRIEF DESCRIPTION OF THE DRAWINGS

Further advantageous embodiments and aspects of the household dishwasher are the subject matter of the subclaims and the exemplary embodiments of the household dishwasher described below. In addition, the household dishwasher is described in more detail with reference to preferred embodiments and with reference to the attached figures.

DETAILED DESCRIPTION OF EXEMPLARY EMBODIMENTS OF THE PRESENT INVENTION

Figure 1:
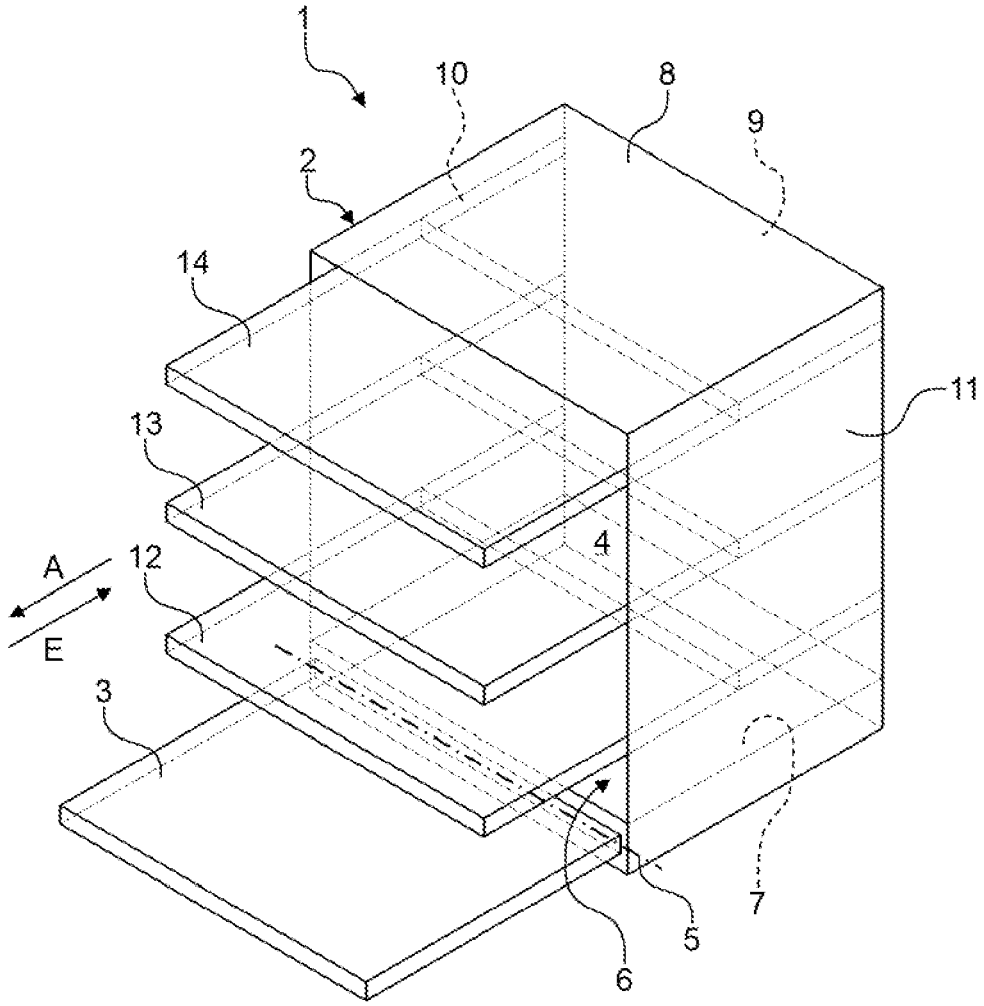
FIG. 1 shows a schematic perspective view of an embodiment of a household dishwasher.

Unless specified otherwise, in the figures, the same elements or elements having similar functions are given the same reference characters.

FIG. 1 shows a schematic perspective view of an embodiment of a household dishwasher 1. The household dishwasher 1 comprises a washing container 2, which can be closed by a door 3, in particular in a watertight manner. For this purpose, a sealing system can be provided between the door 3 and the washing container 2. The washing container 2 is preferably cuboidal. The washing container 2 can be arranged in a housing of the household dishwasher 1. The washing container 2 and the door 3 can form a washing chamber 4 for washing dishwasher loads.

In FIG. 1, the door 3 is depicted in its open position. The door 3 can be closed or opened by pivoting about a pivot axis 5 provided at a lower end of the door 3. The door 3 can be used to close or open a loading opening 6 of the washing container 2. The washing container 2 has a floor 7, a top 8 arranged opposite the floor 7, a rear wall 8 arranged opposite the closed door 3 and two side walls 10, 11 arranged opposite one another. The floor 7, the top 8, the rear wall 9 and the side walls 10, 11 can, for example, be made of a stainless steel sheet. Alternatively, the floor 7 can, for example, be made of a plastic material.

The household dishwasher 1 furthermore has at least one dishwasher load receptacle 12 to 14. Preferably, a plurality of, for example three, dishwasher load receptacles 12 to 14 can be provided, wherein the dishwasher load receptacle 12 can be a lower dishwasher load receptacle or a lower basket, the dishwasher load receptacle 13 can be an upper dishwasher load receptacle or an upper basket and the dishwasher load receptacle 14 can be a cutlery drawer. As FIG. 1 furthermore shows, the dishwasher load receptacles 12 to 14 are arranged one above the other in the washing container 2. Each dishwasher load receptacle 12 to 14 can be optionally moved into or out of the washing container 2. In particular each dishwasher load receptacle 12 to 14 can be pushed or moved into the washing container 2 in an insertion direction E and can be pulled out or moved out of the washing container against the insertion direction E in a pull-out direction.

Figure 2:
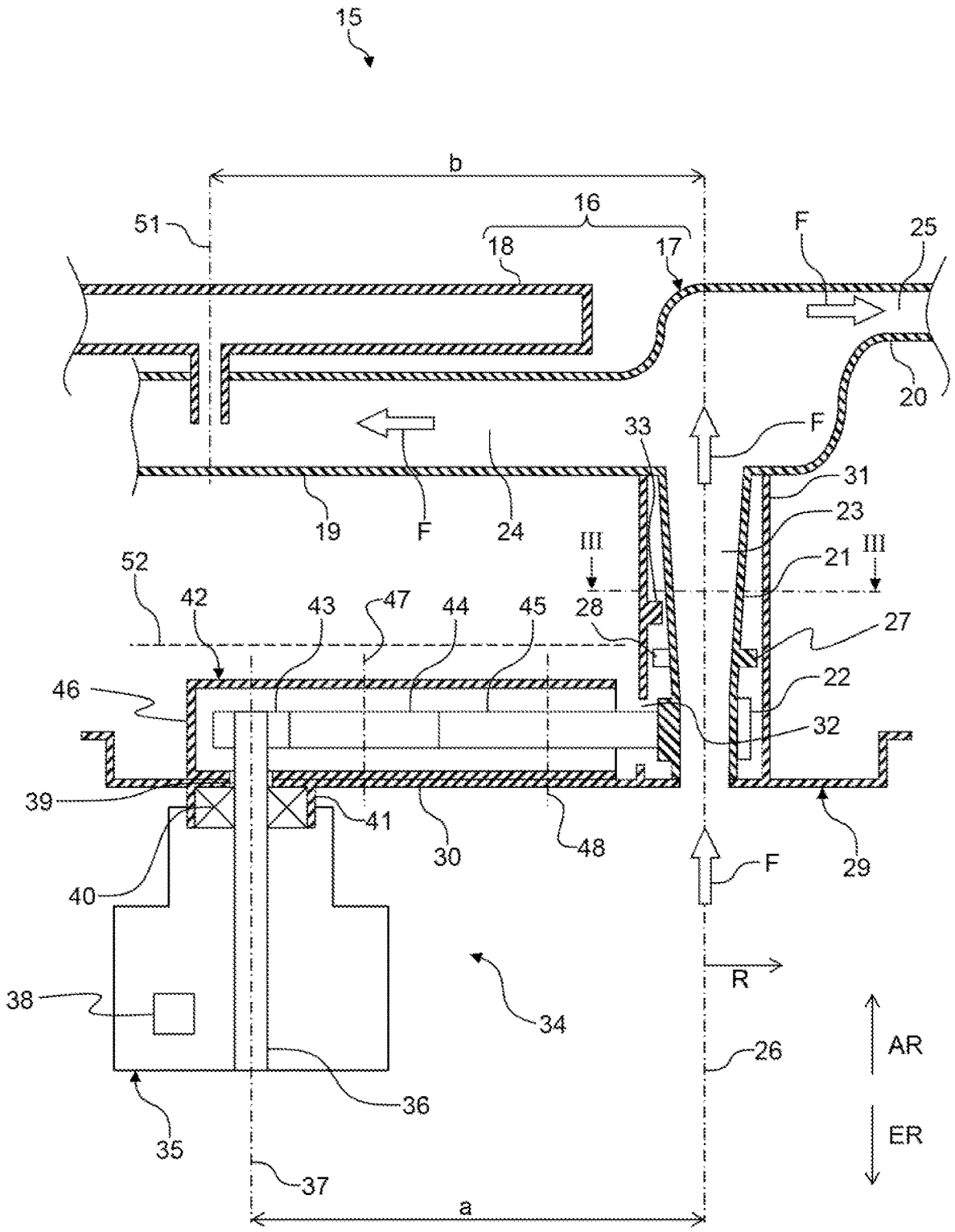
FIG. 2 shows a schematic sectional view of an embodiment of a controlled spray arm or spray system or apparatus for the household dishwasher according to FIG. 1.
Figure 3:
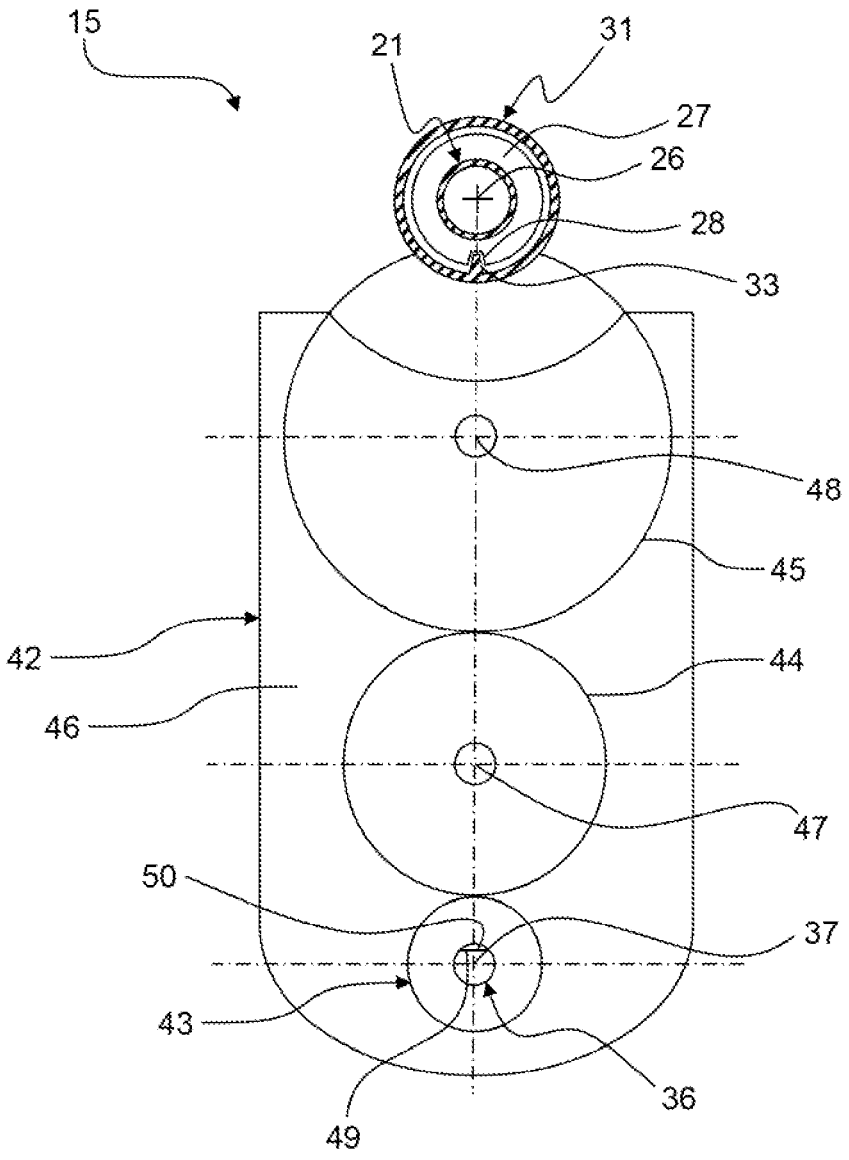
FIG. 3 shows a further schematic sectional view of the spray apparatus according to the line of intersection III-III in FIG. 2.

FIG. 2 shows a schematic sectional view of an embodiment of a controlled spray arm or spray system or apparatus 15 for the household dishwasher 1. FIG. 3 shows a schematic sectional view of the controlled spray arm 15 according to the line of intersection III-III in FIG. 2. The following refers to FIGS. 2 and 3 simultaneously.

The controlled spray arm 15 is arranged within the washing container 2. In particular, the controlled spray arm 15 is positioned beneath the dishwasher load receptacle 12. The controlled spray arm 15 can be positioned on the floor 7. The controlled spray arm 15 comprises a spray arm 16 for applying washing liquor and/or fresh water F to the dishwasher load (not shown) received in the washing container. The spray arm 16 comprises a cross-arm 17, which is actively driven, and a spray arm satellite 18 rotatably mounted on the cross-arm 17. The spray arm satellite 18 can have a plurality of arms. For example, the spray arm satellite 18 can have three arms arranged offset to one another by an angle of 120°. The cross-arm 17 can have spray nozzles (not shown).

The spray arm satellite 18 is not actively driven. This means that the spray arm satellite 18 does not have its own drive system. In particular, the spray arm satellite 18 is reactively driven with the aid of the washing liquor and/or the fresh water F. In the present case, "reactively driven" should be understood to mean that the spray arm satellite 18 has a plurality of spray nozzles (not shown) through which the washing liquor and/or the fresh water F can emerge from the spray arm satellite 18 and sets this into rotation.

On the other hand, in contrast to the spray arm satellite 18, the cross arm 17 is actively driven. However, alternatively, the cross-arm 17 can also be reactively driven. The cross-arm 17 comprises a first arm 19 on which the spray arm satellite 18 is rotatably mounted and a second arm 20. The arms 19, 20 can have spray nozzles (not shown). Preferably, two such arms 19, 20 are provided. The number of arms 19, 20 is arbitrary. It is also possible for precisely one arm 19, 20 or more than two arms 19, 20 to be provided.

Both the spray arm satellite 18 and the cross-arm 17 are embodied as hollow so that the washing liquor and/or the fresh water F can flow through the cross-arm 17 and the spray arm satellite 18. The arms 19, 20 of the cross-arm 17 are connected to a venturi tube or bearing tube 21. The bearing tube 21 is a venturi tube or can be referred to as a venturi tube. The bearing tube 21 can also be referred to as a bearing part. The bearing tube 21 is suitable for supplying the washing liquor and/or the fresh water F to the arms 19, 20. The bearing tube 21 can be embodied as conical. Spray-arm toothing 22 with a multiplicity of teeth is provided on the outer side of the bearing tube 21. The arms 19, 20 are, for example, made of polypropylene (PP), in particular glass-fiber reinforced polypropylene. On the other hand, the bearing tube 21 can be made of polyoxymethylene (POM). Accordingly, the bearing tube 21 can also be referred to as a POM bearing tube or POM bearing part. This means that the bearing tube 21 and the arms 19, 20 can be made of different plastic materials. For example, the arms 19, 20 and the bearing tube 21 can be firmly connected to one another in a plastic injection molding process with the aid of the encapsulation of the different plastic materials.

The arms 19, 20 can be embodied in one piece, in particular in one piece of material. Herein, in the present case, "in one piece" means that the arms 19, 20 form a common component and are not composed of different components. In the present case, "in one piece of material" means that the arms 19, 20 are made of the same material throughout. Accordingly, the bearing tube 21 and the spray-arm toothing 22 can also be embodied in one piece, in particular in one piece of material.

The bearing tube 21 comprises on the inner side a cone-shaped or tapered cavity 23, through which the washing liquor and/or the fresh water F can flow into cavities 24, 25 of the arms 19, 20. An axis of rotation 26 is assigned to the spray arm 16, in particular the cross-arm 17, about which axis the spray arm 16, in particular the cross-arm 17, can be rotated. A rib geometry 27 that revolves around the axis of rotation 26 is provided on the spray arm 16, in particular on the cross-arm 17. The rib geometry 27 is in particular provided on the bearing tube 21. The rib geometry 27 is embodied in one piece, in particular in one piece of material, with the bearing tube 21. Herein, the rib geometry 27 revolves around the axis of rotation 26 in the shape of a disk. Herein, the rib geometry 27 is arranged between the spray-arm toothing 22 and the arms 19, 20.

As FIG. 2 shows, viewed along the axis of rotation 26, the rib geometry 27 is positioned spaced apart from the spray-arm toothing 22. The rib geometry 27 comprises an encoding groove 28 running along the axis of rotation 26, the function of which will be explained below. The encoding groove 28 constitutes an interruption of the rib geometry 27 running along the axis of rotation 26. This means that the rib geometry 27 runs completely around the bearing tube 21 as far as the encoding groove 28.

The controlled spray arm 15 furthermore comprises a pump pot 29. The pump pot 29 is preferably a plastic injection-molded component. The pump pot 29 has a disk-shaped base section 30. In the orientation at the top of FIG. 2, a tube-shaped pump pot dome 31 extends out of the base section 30. The pump pot dome 31 extends in the direction of the top 8. The bearing tube 21 is received and rotatably mounted in the pump pot dome 31. However, the way in which the bearing tube 21 is mounted in the pump pot dome 31 is not depicted in FIG. 2.

The pump pot dome 31 comprises a radial aperture 32. Herein, "radial" should be understood to mean with reference to a radial direction R of the pump pot dome 31. The radial direction R is oriented away from and perpendicular to the axis of rotation 26. Hence, the aperture 32 passes through the pump pot dome 31 in the radial direction R. Through the aperture 32, it is possible to engage in the spray-arm toothing 22 in a form-fitting manner, as will be explained below. The aperture 32 can be rectangular.

The pump pot dome 31 furthermore comprises an encoding rib 33 corresponding to the encoding groove 28. The encoding rib 33 extends on the inner side out of the tubular pump pot dome 31 in the direction of the bearing tube 21 without making contact therewith. The encoding rib 33 runs along the axis of rotation 26. Herein, the encoding rib 33 can be guided through the encoding groove 28 along the axis of rotation 26 during the assembly and disassembly of the spray arm 16, in particular the cross-arm 17, so that the spray arm 16, in particular the cross-arm 17, can only be assembled and disassembled again from the pump pot 29 in precisely one angular position. The encoding rib 33 can have a rectangular or triangular geometry. However, the geometry of the encoding rib 33 can also be based on or be very similar to the involute shape of the spray-arm toothing 22. The encoding groove 28 is then embodied in a corresponding manner.

The controlled spray arm 15 furthermore comprises a drive system 34 for actively driving the spray arm 16. The drive system 34 comprises a drive element 35, in particular an electric motor, with a drive shaft 36, which rotates about an axis of rotation 37 when the drive system 34 is in operation. Hence, in the present case, "actively driven" means that the spray arm 16 is set into rotation with the aid of the drive element 35 and not, for example, with the aid of spray nozzles. The axis of rotation 37 of the drive shaft 36 and the axis of rotation 26 of the spray arm 16 are arranged parallel to one another and spaced apart from one another by a distance a.

The drive element 35 comprises a sensor system 38 with the aid of which an angular position of the drive shaft 36 can be detected. The sensor system 38 can, for example, comprise a fork light barrier and a perforated disk or a cam disk and a switching contact or a Hall sensor. However, the type of embodiment of the sensor system 38 is arbitrary. Any type of sensor with the aid of which the angular position of the drive shaft 36 can be detected is suitable for the sensor system 38.

The drive shaft 36 is guided through a drill hole 39 in the base section 30 of the pump pot 29. The drive shaft 36 is sealed in a fluid-tight manner from a cylindrical receiving section 41 of the pump pot 29 with the aid of a sealing element 40, in particular with the aid of a shaft sealing ring.

The drive system 34 furthermore comprises a gear 42 for transmitting torque from the drive shaft 36 to the spray arm 16, in particular to the spray-arm toothing 22 of the cross-arm 17. The gear 42 can also be referred to as a gear box, gear module or gear unit. The gear 42 can comprise straight-toothed or helical-toothed gear wheels 43 to 45, a bevel gear, a belt drive or a chain drive. The gear wheels 43 to 45 bridge the distance a between the drive shaft 36, in particular the axis of rotation 37, and the spray arm 16, in particular the axis of rotation 26. The number of gear wheels 43 to 45 is basically arbitrary.

The gear 42 comprises a gear housing 46 in which the gear wheels 43 to 45 are rotatably mounted. For example, a first gear wheel 43 is rotatably mounted about the axis of rotation 37 in the gear housing 46, a second gear wheel 44 is rotatably mounted about an axis of rotation 47 in the gear housing 46 and a third gear wheel 45 is rotatably mounted about an axis of rotation 48 in the gear housing 46.

The first gear wheel 43 is coupled to the drive shaft 36 in a rotationally fixed manner. For this purpose, the drive shaft 36 has an engagement section 49 in the form of a lateral flattened or milled area. The first gear wheel 43 has a counter-engagement section 50 corresponding to the engagement section 49. The engagement section 49 and the counter-engagement section 50 engage in one another in a form-fitting manner. A form-fitting connection is created by at least two connection partners engaging in or behind one another, in the present case the engagement section 49 and the counter-engagement section 50. However, the engagement section 49 and the counter-engagement section 50 can also be a splined shaft contour with a corresponding encoding tooth. The third gear wheel 45 is engaged with the spray-arm toothing 22, wherein the second gear wheel 44 is arranged between the gear wheels 43, 45. The axes of rotation 26, 37, 47, 48 are arranged parallel to one another and spaced apart from one another.

When the controlled spray arm 15 is in operation, the spray arm satellite 18 rotates about an axis of rotation 51 on the cross-arm 17. The axes of rotation 26, 51 are arranged spaced apart from one another by a distance b. The axes of rotation 26, 51 are positioned parallel to one another. Furthermore, a filter system 52 under which the gear 42 is arranged is assigned to the pump pot 29. This means that the gear 42 is positioned between the base section 30 of the pump pot 29 and the filter system 52. This can prevent soiling of the gear 42. The filter system 52 can be in several parts and comprise a fine filter and a coarse filter.

The functionality of the controlled spray arm 15 is explained below. When the household dishwasher 1 is in operation, the washing liquor and/or the fresh water F is conveyed with the aid of a circulating pump (not shown) and supplied to the spray arm 16. The washing liquor and/or the fresh water F is supplied to the spray arm satellite 18 via the cross-arm 17. The spray arm satellite is set into rotation around the axis of rotation 51 by the washing liquor and/or fresh water F emerging from spray nozzles (not shown). The spray arm 16 itself is set into rotation around the axis of rotation 26 with the aid of the drive system 34. Herein, the rotational speed of the cross-arm 17 can be set as desired. The rotational speed of the cross-arm 17 can also vary during a washing program. The cross-arm 17 can also remain in a preselected position so that the spray arm satellite 18 can realize an intensive washing zone which is exposed to the action of washing liquor and/or fresh water F without the cross-arm 17 rotating.

If the spray arm 16 is now to be disassembled, for example for cleaning purposes, it can only be pulled out of the pump pot dome 31 in a withdrawal direction AR along the axis of rotation 26, if, as shown in FIG. 3, viewed along the axis of rotation 26, the encoding rib 33 is positioned precisely above the encoding groove 28. Herein, the angular position of the drive shaft 36 of the drive element 35 can be detected with the aid of the sensor system 38. This means that the position of the interlocking gear wheels 43 to 45 is likewise known.

Conversely, the spray arm 16 can only be reassembled when the encoding groove 28 is located precisely above the encoding rib 33. Only then can the spray arm 16 be pushed in or inserted into the pump pot dome 31 in an insertion direction ER such that the spray-arm toothing 22 engages in the third gear wheel 45 in a form-fitting manner. For example, for assembly and disassembly purposes, the spray arm 16 can always be positioned at 6 o'clock. It is hence possible to determine the angle and control the position of the spray arm 16 via the sensor system 38 of the drive element 35.

There is no need for additional sensors to detect the angular position of the spray arm 16, in particular the cross-arm 17. This eliminates the need for sensors in the wet region of the household dishwasher 1. For the user and assembler, clear assembly and disassembly is possible in only one position in each case. Hence, a poka-yoke solution can be achieved. Multistage toothing including transmission in the gear wheels 43 to 45 is also possible. The positioning is also possible via other types of torque transmission, for example with the aid of a V-belt or a toothed belt.

Although, the present invention was described with reference to exemplary embodiments it may be modified in many ways.

The invention claimed is:

1. A household dishwasher, comprising:

a washing container for receiving a dishwasher load;

a pump pot;

a spray arm for applying washing liquor and/or fresh water to the dishwasher load in the washing container, said spray arm being mounted on the pump pot for rotation about an axis of rotation, said spray arm comprising a rib geometry around the axis of rotation and having an encoding groove running along the axis of rotation; and a drive system for actively driving the spray arm, wherein the pump pot comprises an encoding rib running along the axis of rotation and corresponding to the encoding groove, said encoding rib configured for passage through the encoding groove along the axis of rotation during assembly and disassembly of the spray arm so as to enable the spray arm to be assembled on and disassembled from the pump pot in precisely one angular position.

2. The household dishwasher of claim 1, wherein the pump pot comprises a tubular pump pot dome on which the spray arm is mounted for rotation about the axis of rotation, said encoding rib being provided on an inner side of the pump pot dome.

3. The household dishwasher of claim 1, wherein the drive system comprises a drive element having a drive shaft mounted for rotation about an axis of rotation.

4. The household dishwasher of claim 3, wherein the drive element comprises a sensor system for detecting an angular position of the drive shaft.

5. The household dishwasher of claim 3, wherein the spray arm comprises a cross-arm which is rotatably mounted on the pump pot and is actively driven by the drive system, and a spray arm satellite which is rotatably mounted on the cross-arm.

6. The household dishwasher of claim 3, wherein the axis of rotation of the spray arm and the axis of rotation of the drive shaft are arranged parallel to one another and spaced apart from one another.

7. The household dishwasher of claim 6, further comprising a gear bridging a distance between the axis of rotation of the spray arm and the axis of rotation of the drive shaft.

8. The household dishwasher of claim 7, wherein the drive shaft comprises an engagement section configured to engage in a corresponding counter-engagement section of a gear wheel of the gear in a form-fitting manner so as to enable assembly of the gear wheel on the drive shaft in precisely one angular position.

9. The household dishwasher of claim 7, wherein the gear comprises a plurality of gear wheels, one of the plurality of gear wheels being assembled on the drive shaft and another one of the plurality of gear wheels engaging in a spray-arm toothing of the spray arm in a form-fitting manner.

10. The household dishwasher of claim 9, wherein, viewed along the axis of rotation of the spray arm, the rib geometry is arranged spaced apart from the spray-arm toothing.

11. A controlled spray arm for a household dishwasher having a washing container and a pump pot, comprising:

a spray arm for applying washing liquor and/or fresh water to a dishwasher load in the washing container, said spray arm being mounted on the pump pot for rotation about an axis of rotation, said spray arm comprising a rib geometry around the axis of rotation and having an encoding groove running along the axis of rotation; and a drive system for actively driving the spray arm, wherein the pump pot comprises an encoding rib running along the axis of rotation and corresponding to the encoding groove, said encoding rib configured for passage through the encoding groove along the axis of rotation during assembly and disassembly of the spray arm so as to enable the spray arm to be assembled on and disassembled from the pump pot in precisely one angular position.

12. The controlled spray arm of claim 11, wherein the pump pot comprises a tubular pump pot dome on which the spray arm is mounted for rotation about the axis of rotation, said encoding rib being provided on an inner side of the pump pot dome.

13. The controlled spray arm of claim 11, wherein the drive system comprises a drive element having a drive shaft mounted for rotation about an axis of rotation.

14. The controlled spray arm of claim 13, wherein the drive element comprises a sensor system for detecting an angular position of the drive shaft.

15. The controlled spray arm of claim 13, wherein the spray arm comprises a cross-arm which is rotatably mounted on the pump pot and is actively driven by the drive system, and a spray arm satellite which is rotatably mounted on the cross-arm.

16. The controlled spray arm of claim 13, wherein the axis of rotation of the spray arm and the axis of rotation of the drive shaft are arranged parallel to one another and spaced apart from one another.

17. The controlled spray arm of claim 16, further comprising a gear bridging a distance between the axis of rotation of the spray arm and the axis of rotation of the drive shaft.

18. The controlled spray arm of claim 17, wherein the drive shaft comprises an engagement section configured to engage in a corresponding counter-engagement section of a gear wheel of the gear in a form-fitting manner so as to enable assembly of the gear wheel on the drive shaft in precisely one angular position.

19. The controlled spray arm of claim 17, wherein the gear comprises a plurality of gear wheels, one of the plurality of gear wheels being assembled on the drive shaft and another one of the plurality of gear wheels engaging in a spray-arm toothing of the spray arm in a form-fitting manner.

20. The controlled spray arm of claim 19, wherein, viewed along the axis of rotation of the spray arm, the rib geometry is arranged spaced apart from the spray-arm toothing.

* * * * *